US006198407B1

(12) United States Patent
Koga

(10) Patent No.: US 6,198,407 B1
(45) **Date of Patent: *Mar. 6, 2001**

(54) RADIO PAGING RECEIVER

(75) Inventor: Kuniaki Koga, Kakegawa (JP)

(73) Assignee: NEC Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 08/932,219

(22) Filed: Sep. 17, 1997

(30) Foreign Application Priority Data

Sep. 17, 1996 (JP) ..... 8-245212

(51) Int. Cl.[7] ..... G08B 5/22
(52) U.S. Cl. ..... 340/825.44
(58) Field of Search ..... 340/825.44, 825.47, 340/825.69, 825.52, 825.49, 825; 455/38.1; 379/57, 59

(56) References Cited

U.S. PATENT DOCUMENTS

| | | | | |
|---|---|---|---|---|
| 4,774,658 | * | 9/1988 | Lewin | 340/825.49 |
| 4,856,047 | * | 8/1989 | Saunders | 455/31.2 |
| 4,860,335 | * | 8/1989 | Namekawa | 455/404 |
| 5,493,284 | * | 2/1996 | Kondo | 340/825.44 |

FOREIGN PATENT DOCUMENTS

| | | |
|---|---|---|
| 762 351 A1 | 3/1997 | (EP) . |
| 3-18136 | 1/1991 | (JP) . |
| 3-127523 | 5/1991 | (JP) . |
| 4-326632 | 11/1992 | (JP) . |
| 7-99679 | 4/1995 | (JP) . |
| 9-55969 | 2/1997 | (JP) . |

* cited by examiner

*Primary Examiner*—Howard L. Williams
*Assistant Examiner*—Jean B. Jeanglaude
(74) *Attorney, Agent, or Firm*—Scully, Scott Murphy & Presser

(57) ABSTRACT

A Radio Paging Receiver includes several types of notifying elements such as a speaker, vibrator, and an LED, and a memory for storing notification information to link one of the notifying elements with a time section where notification by one of the notifying elements is conducted. Also included is one or more switches which allow a user to input the notification information, and structure for writing the notification information for input by the switches into the memory, selecting one of the notifying elements corresponding to a time section in which a call time belongs when the radio paging receiver is called according to the notification information stored in the memory, and controlling notification of the call by one of the notifying elements.

8 Claims, 6 Drawing Sheets

| ADDRESS | TIME | MODE |
|---|---|---|
| 0001 | 1:00 | 1 |
| 0002 | 1:10 | 5 |
| 0003 | 1:20 | 2 |
| 0004 | 1:30 | 3 |
| ⋮ | ⋮ | ⋮ |

A : AM , P : PM

≋ : VIBRATOR

♪ : MELODY

ALARM

RADIO PAGING RECEIVER

FIELD OF THE INVENTION

This invention relates to a radio paging receiver, and more particularly to, a radio paging receiver where call-notifying means can be changed according to a designated time section.

BACKGROUND OF THE INVENTION

In general, a radio paging receiver has a function notifying its user of a call. This notifying function is the most important factor that determines the utility of a radio paging receiver. For example, for users, a call with normal volume is convenient under the circumstance that is not noisy to others. On the contrary, in a meeting, such a call is noisy to others. Therefore, desired is a radio paging receiver whose notification can be performed according to circumstances.

Under these backgrounds, there have been developed radio paging receivers with various notifying means, e.g., melody sound, vibration and LED (light emitting diode) other than alert sound. Meanwhile, the setting of notifying means can be changed by user's manual switching operation or according to channels of the receiver.

Also, a radio paging receiver where call-notifying means can be changed according to a designated time section has been suggested. For example, Japanese patent application laid-open No. 4-326632 (1994) discloses a radio paging receiver where a second notifying means other than a notifying means normally used is provided to use for a call within a designated time section and, for the other call, the normal notifying means is used. In this radio paging receiver, its user can be automatically notified of a call according to the circumstances by designating the time section to be notified by the second notifying means for a desired time period, e.g., a meeting time.

However, it is still troublesome for its user to change the notifying means by the switching operation according to the change of circumstances since the user's living circumstances generally include various time schedules such as commuter, meeting and sleep times. Further, the time section to be notified by the second notifying, e.g., meeting time, may be changed day by day. Thus, the setting of the time section needs to be changed again.

SUMMARY OF THE INVENTION

Accordingly, it is an object of the invention to provide a radio paging receiver where call-notifying means can be easily set according to user's living circumstances.

According to the invention, a radio paging receiver, comprises:

plural types of notifying means;

means for storing notification information to link one of the plural types of notifying means with a time section where notification by the one of the plural types of notifying means is conducted;

means for inputting the notification information; and means for writing the notification information to be input by the inputting means in the storing means, selecting one of the plural types of notifying means corresponding to a time section where a call time belongs to when the radio paging receiver is called according to the notification information stored in the storing means, and controlling notification of the call by the one of the plural types of notifying means.

BRIEF DESCRIPTION OF THE DRAWINGS

The invention will be explained in more detail in conjunction with the appended drawings, wherein.

DESCRIPTION OF THE PREFERRED EMBODIMENTS

A radio paging receiver in the preferred embodiment will be explained in FIG. 1.

Figure 1:
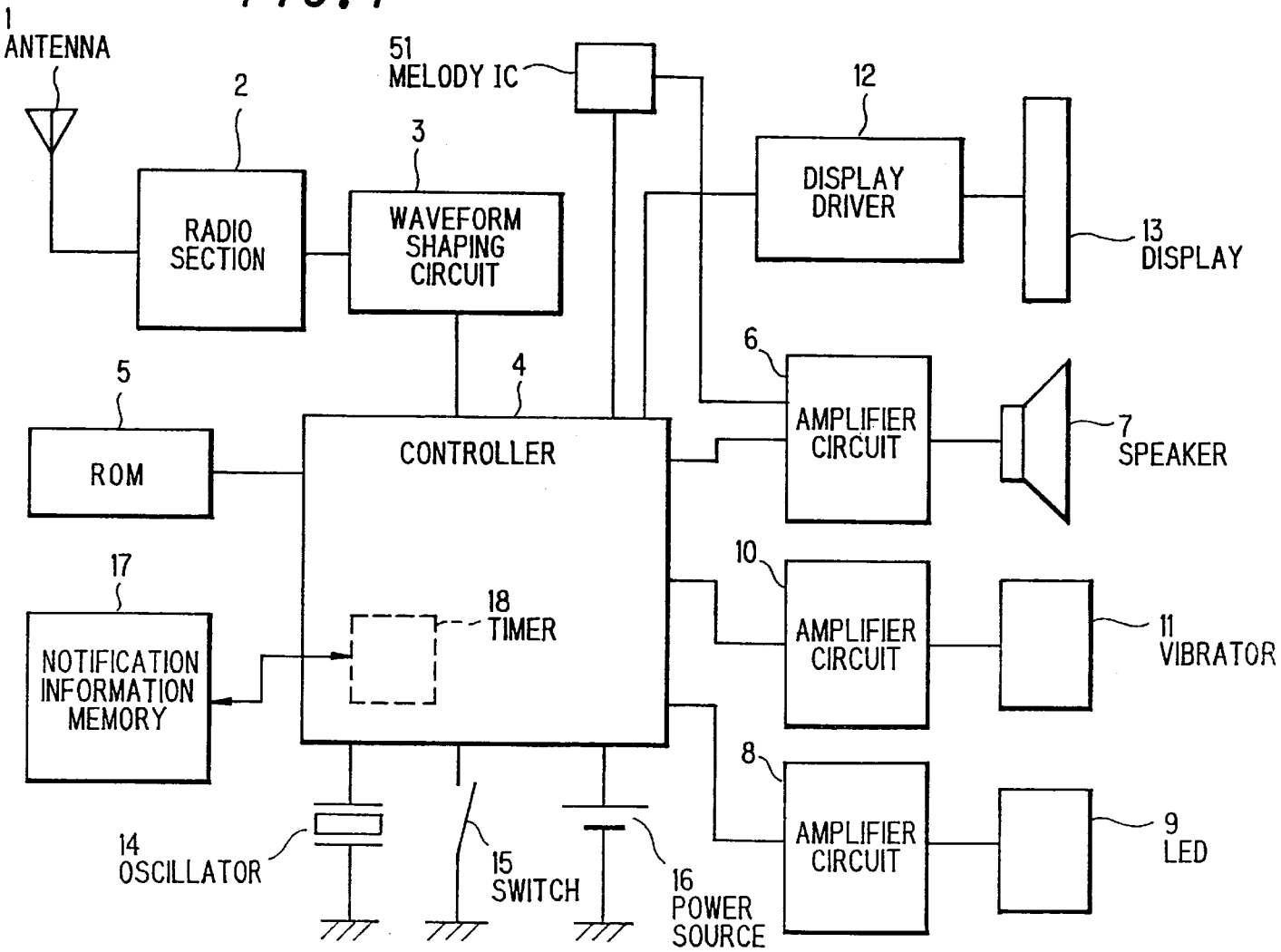
FIG. 1 is a block diagram showing a radio paging receiver in a preferred embodiment according to the invention.

In FIG. 1, a radio section 2 includes means for amplifying and demodulating a radio signal to be received by antenna 1. A waveform shaping circuit 3 serves to shape the demodulated signal obtained from the radio section 2 into a waveform which can be read by a controller 4.

ROM (read-only memory) 5 is a writable-type memory, where a call number of the radio paging receiver is previously written.

Figures 2, 3:
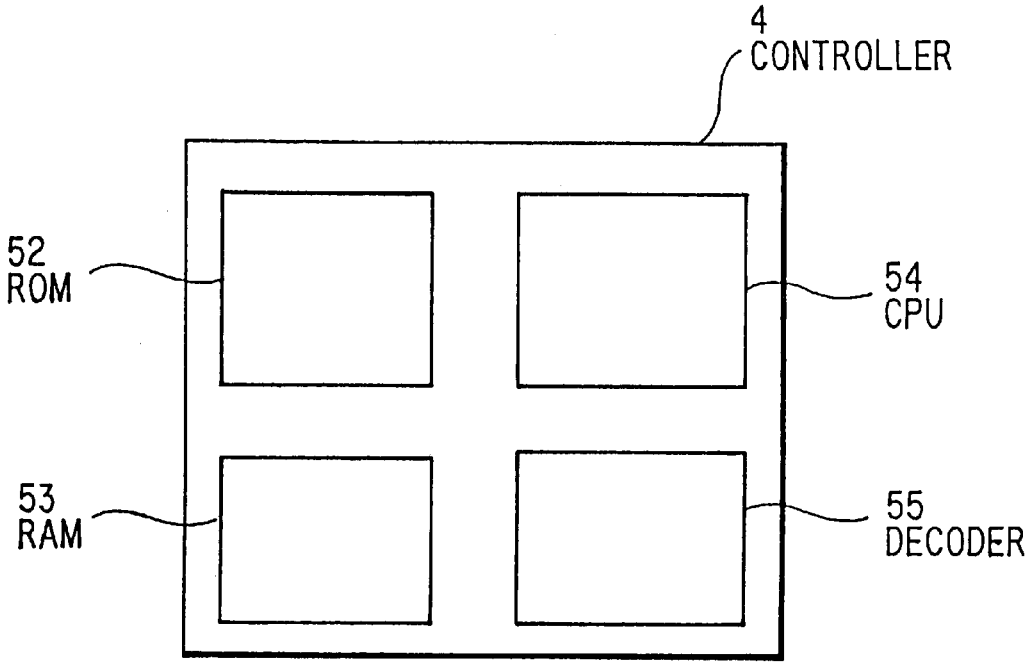
FIG. 2 is a block diagram showing a detailed composition of a controller 4 in FIG. 1.
FIG. 3 is a table showing a method of storing melody sounds used in the embodiment.

The controller 4 controls parts of the radio paging receiver according to a clock to be supplied from an oscillator 14. As shown in FIG. 2, the controller 4 comprises ROM 52 storing software to control operations of the controller 4, RAM (random-access memory) 53 to store a received data, CPU 54 for controlling the entire controller 4, and a decoder 55 for decoding a signal input from the radio section 2. Also, the controller 4 has a timer 18 to output time information representing current time. A switch 15 is provided so that its user inputs various information including commands to the controller 4. 16 is a power source for the radio paging receiver.

The controller 4 compares a call number included in the modulated signal with the call number stored in ROM 5 when it receives the demodulated signal through the waveform shaping circuit 3 from the radio section 2. Then, if both the numbers are identical, i.e., if the radio paging receiver is called, notification is conducted by using a notifying means, which will be explained later. Further, when the modulated signal includes a message, the controller 4 drives a display 13 through a display driver 12 to display the message.

The radio paging receiver of this embodiment has some notifying means for generating an alert sound, a melody sound, vibration, light (LED). A speaker 7, a vibrator 11 and LED 9, respectively, are elements composing these notifying means. The controller 4 drives selectively the speaker 7, vibrator 11 or LED 9 through amplifier circuits 6, 10 and 8 to notify the calling. For example, different melody sounds may be previously prepared or produced by the user. In the former case, the previously prepared melody sounds are, as shown in FIG. 3, stored in a melody IC 51 which outputs data to the amplifier circuit 6 of the speaker 7 according to the control signal of the controller 4. In FIG. 3, mode numbers are corresponding to melody sounds. In the latter case, the user can make a melody by using the display 13 and switch 15 etc and store it in the melody IC 51. The melody sound produced by the user can be also selectively used according to the control signal of the controller 4.

A notification information memory 17 stores notification information which links the start time and end time of a time section for notification with any one of the notifying means. The user can input the notification information by operating the switch 15 to store it in the notification information memory 17. Also, the contents of the notification information can be displayed on the display 13 through an user's predetermined operation to the switch 15 by the controller 4.

Figure 4:
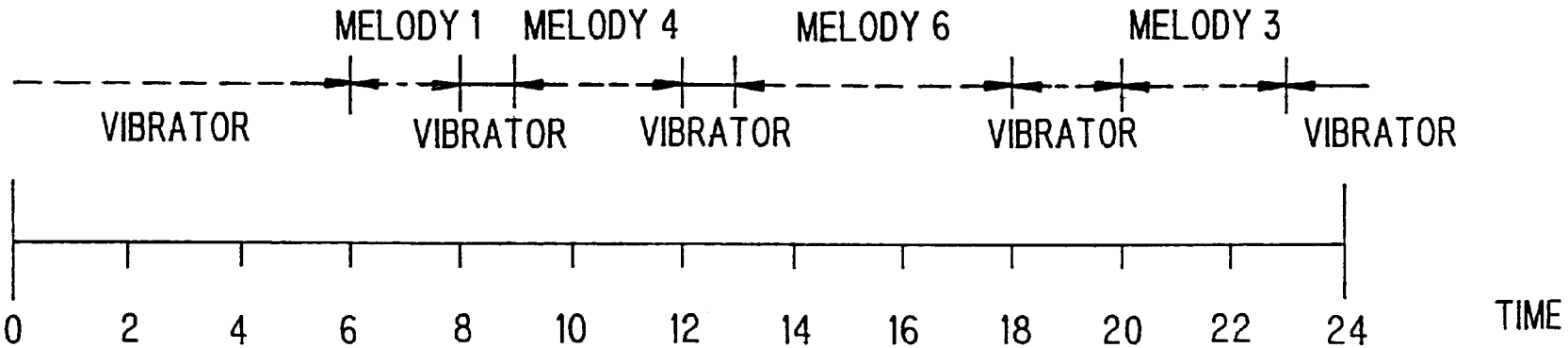
FIG. 4 is an example of a time table for generating different notifying means used in the embodiment.
Figure 5:
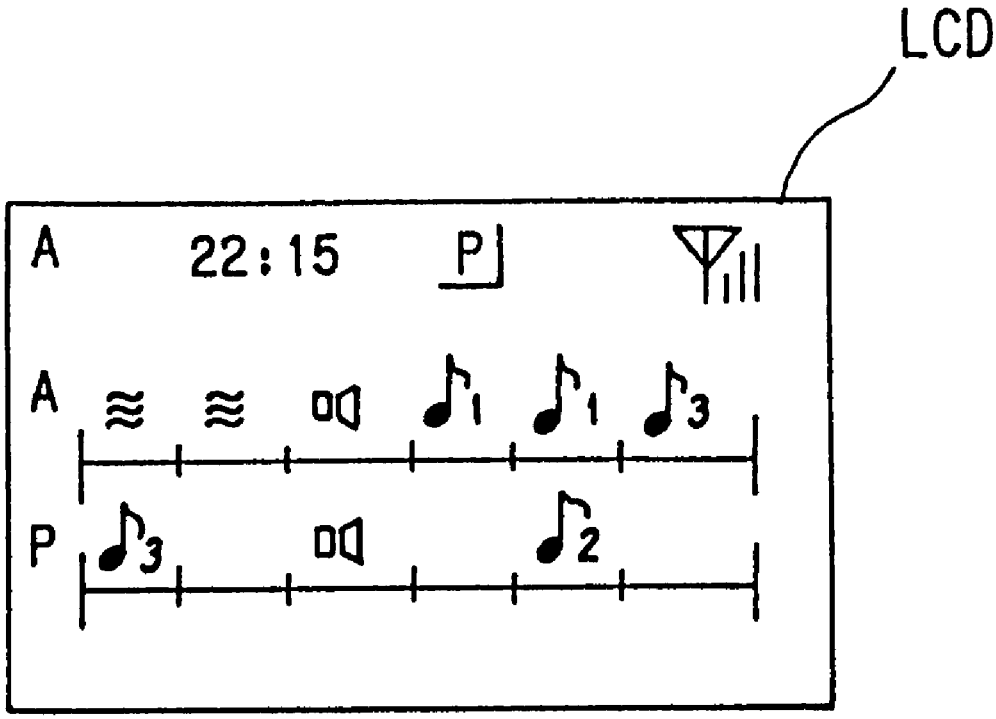
FIG. 5 is a plan view showing a display example of LCD 13 in FIG. 1.

FIG. 4 shows an example of time table of the notification information, and FIG. 5 shows an example of an actual displaying of the notification information on the display 13. As shown in FIG. 5, the display (LCD) 13 displays a time scale corresponding to the length of one day (24 hours), which is divided at intervals of two hours, and icons representing the notifying means provided for the respective time sections along the time scale. Hereinafter, this type of displaying of the notification information is referred to as '24H table'. In the 24H table shown in FIG. 4, notifying by the vibrator 11 is assigned to time sections for 23 to 6 o'clock (sleeping time), 8 to 9 o'clock and 18 to 20 o'clock (commuter times) and 12 to 13 o'clock, notifying with melody 4 to a time section for 9 to 12 o'clock of business hours at company, notifying with another melody 6 to a time section for 13 to 18 o'clock and notifying with yet another melody 3 to a time section for 20 to 23 o'clock of private hours.

The notification information in the notification information memory 17 is referred to by the controller 4 when a call to the radio paging receiver occurs and used to select the notifying means. Namely, when it is exactly called, the controller 4 detects the current time based upon the time information output from the timer 18 and select a time section where the current time belongs from the time sections defined by the notification information in the notification information memory 17. Then, it selects a notifying means corresponding to the time section and drives the notifying means to conduct its notification.

Figure 6:
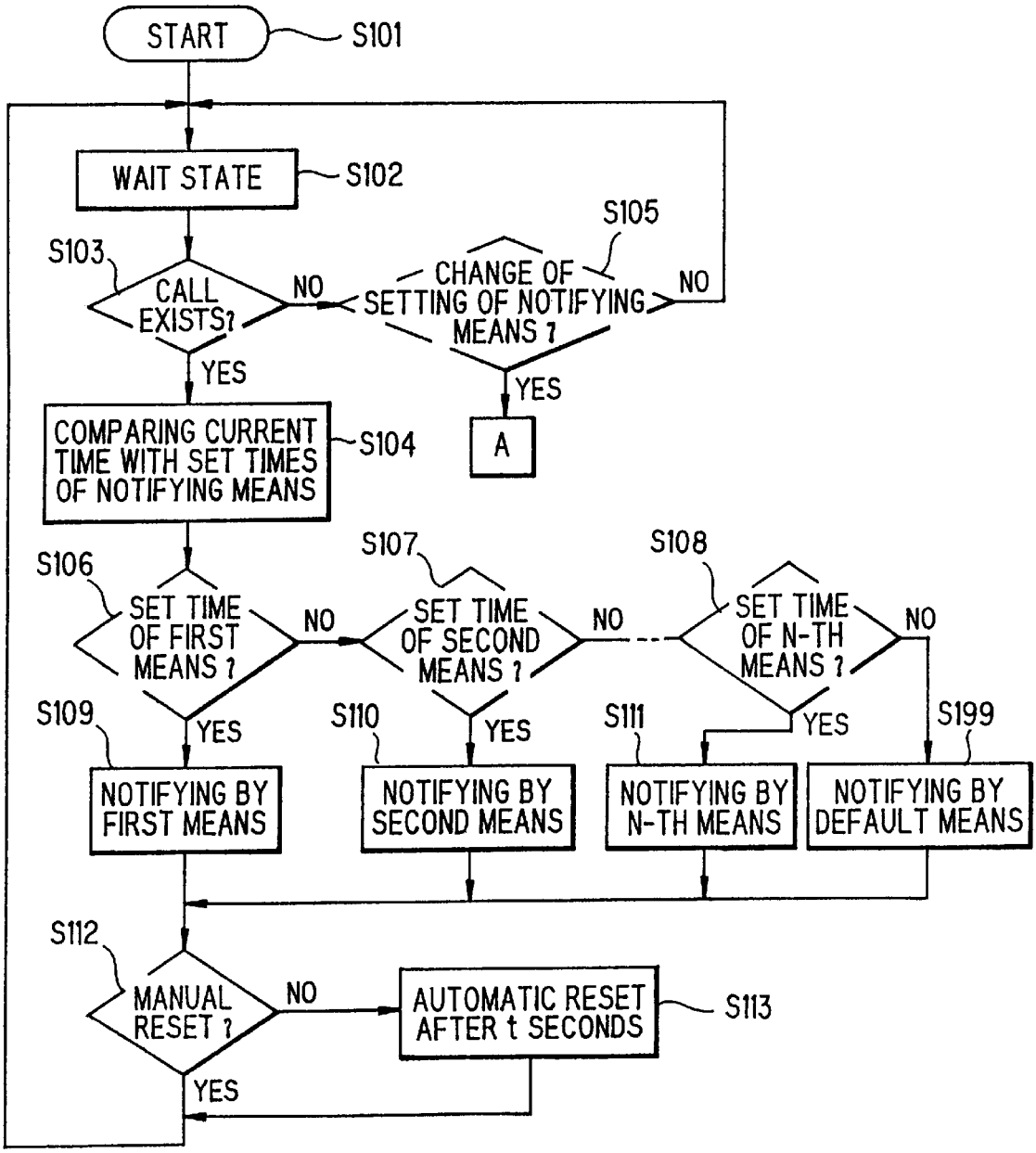
FIGS. 6 and 7 is a flow chart showing an operation of the radio paging receiver in the embodiment.

Next, the operation of the radio paging receiver will be explained referring to a flow chart in FIGS. 6 and 7.

When the radio paging receiver in await state (Steps S101, S102) is exactly called, the controller 4 compares the current time with the time sections corresponding to the notifying means defined by the notification information in the notification information memory 17 (Steps S103, S104).

In this comparison, when the call time (current time) belongs to the time section corresponding to a first notifying means, notification by the first notifying means is conducted (steps S106, S109). On the contrary, when the call time does not belong to the time section corresponding to the first notifying means, whether or not it belongs to the time section corresponding to a second notifying means is judged (Step S107). If YES, notification by the second notifying means is conducted (Step S110). If NO, like judgements can be conducted up to n-th notifying means in case of the radio paging receiver with notifying means of number n, and when there exists a notifying means corresponding to the call time, notification by the notifying means is conducted (Steps S108, S111). Meanwhile, when the call time does not belong to any time section corresponding to the notifying means, notification by a default notifying means is conducted (Steps S108, S109). In general, the default notifying means, which is provided for the case that no notifying means is set by the user, may be an alerting means using an alert sound since a radio paging receiver originally has to notify its user of a call.

After the notification by any notifying means, the radio paging receiver returns to the initial wait state by a manual reset by the user (Step S112) or an automatic reset after a predetermined time. e.g., t seconds (Step S113).

Figure 7:
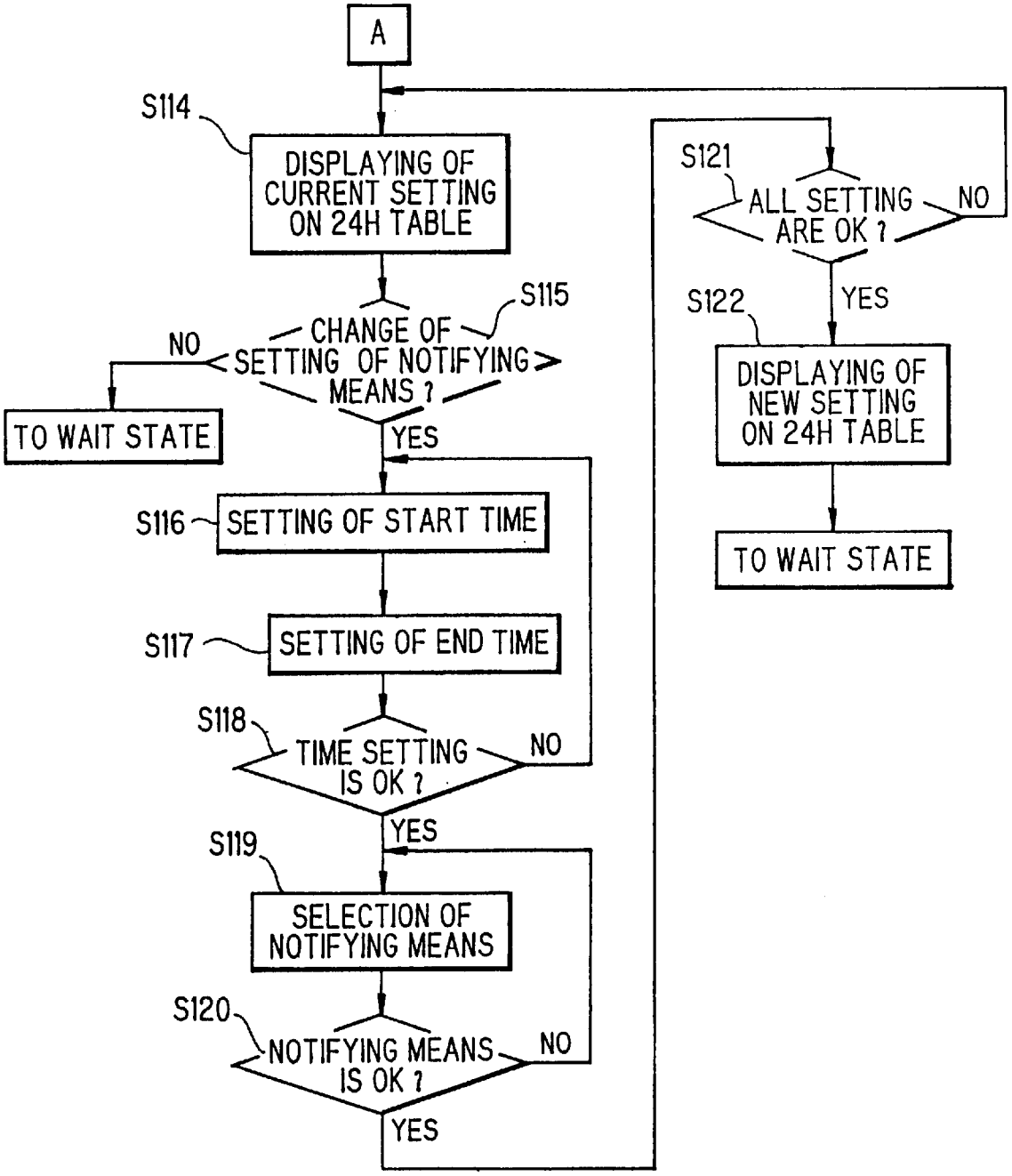

After returning to the wait state (Step S102), when no call exists and an instruction to change the setting of the notifying means is input by the user's operation (Steps S103, S105), a mode for rewriting the notification information starts as shown in FIG. 7.

First, the controller 4 displays the notification information stored in the notification information memory 17 in the form of the 24H table (Step S114). At this time, the user can confirm a notifying means corresponding to a time section, based upon the displaying of the 24H table. If any change of the contents of the notification information is not necessary, the user so operates the switch 15. Thereby, the controller 4 stops the mode for rewriting the notification information and returns to the wait state (Steps S115, S102).

On the other hand, when some change of the contents of the notification information is necessary, the user inputs the start time and end time of a desired time section though the switch 15. The controller 4 takes these times (Steps S116, S117) to display on the display 13.

When the user judges these times to be correct (Step S118) and then the controller 4 takes information of a notifying means corresponding to the above time section from the start time to end time from the user (Step S119), the controller 4 displays the notifying means on the display 13 to prompt the user to confirm (Step S102).

Then, when the designation of the notifying means is confirmed by the user, the contents of the notification information memory 17 are rewritten according to the time section and the notifying means corresponding to the time section which are input through the switch 15 by the user. Next, whether another change of the contents of the notification information is necessary or not is questioned (Step S121). If not necessary, the updated contents of the notification information memory 17 are displayed in the form of the 24H table on the display 13 (Step S122). After the displaying is confirmed by the user, it returns to the wait state (Step S102.)

Although the invention has been described with respect to specific embodiment for complete and clear disclosure, the appended claims are not to be thus limited but are to be construed as embodying all modification and alternative constructions that may be occurred to one skilled in the art which fairly fall within the basic teaching here is set forth.

What is claimed is:

1. A radio paging receiver, comprising:

plural types of notifying means;

means for storing notification information to link one of said plural types of notifying means with a time section where notification by said one of said plural types of notifying means is conducted;

means for inputting said notification information;

means for writing said notification information to be input by said inputting means in said storing means, detecting a call time, selecting one of said plural types of notifying means corresponding to a time section where a call time belongs to when said radio paging receiver is called according to said notification information stored in storing means, and controlling notification of said call by said one of said plural types of notifying means; and means for displaying time sections where notification by said plural types of notifying means is conducted according to said notification information stored in said storing means with a common time scale displayed along an abscissa or X axis of the display means.

2. The radio paging receiver, of claim 1, further comprising:

means for rewriting said notification information stored in said storing means by using notification information to be input from said inputting means.

3. The radio paging receiver, of claim 1, further comprising:

means for rewriting said notification information stored in said storing means by using notification information to be input from said inputting means.

4. The radio paging receiver, of claim 1, wherein:

said notification information is related to said time section up to 24 hours.

5. The radio paging receiver, of claim 1, wherein:

said common time scale have a length of 24 hours.

6. The radio paging receiver of claim 1, wherein said means for displaying time sections further comprises a time table for displaying said notification information.

7. A radio paging receiver, comprising:

plural types of notifying means;

means for storing notification information to link one of said plural types of notifying means with a time section where notification by said one of said plural types of notifying means is conducted;

means for inputting said notification information;

means for writing said notification information to be input by said inputting means in said storing means, selecting one of said plural types of notifying means corresponding to a time section where a call time belongs to when said radio paging receiver is called according to said notification information stored in said storing means, and controlling notification of said call by said one of said plural types of notifying means; and means for displaying time sections where notification by said plural types of notifying means is conducted according to said notification information stored in said storing means with a common time scale displayed along an abscissa or X axis of the display means.

8. The radio paging receiver of claim 7, wherein said means for displaying time sections further comprises a time table for displaying said notification information.

* * * * *